US008668479B2

(12) United States Patent
Shaffer

(10) Patent No.: US 8,668,479 B2
(45) Date of Patent: Mar. 11, 2014

(54) SEMI-HERMETIC SCROLL COMPRESSORS, VACUUM PUMPS, AND EXPANDERS

(75) Inventor: Robert W. Shaffer, Broomfield, CO (US)

(73) Assignee: Air Squad, Inc., Broomfield, CO (US)

( * ) Notice: Subject to any disclaimer, the term of this patent is extended or adjusted under 35 U.S.C. 154(b) by 287 days.

(21) Appl. No.: 12/930,140

(22) Filed: Dec. 29, 2010

(65) Prior Publication Data

US 2011/0176948 A1 Jul. 21, 2011

Related U.S. Application Data

(60) Provisional application No. 61/336,035, filed on Jan. 16, 2010.

(51) Int. Cl.
*F01C 1/02* (2006.01)

(52) U.S. Cl.
USPC ..... 418/55.6; 418/55.1

(58) Field of Classification Search
USPC ..... 418/55.1–55.6, 6, 101, 83–84, 57, 270
See application file for complete search history.

(56) References Cited

U.S. PATENT DOCUMENTS 3,802,809 A * 4/1974 Vulliez ..... 418/5
3,986,799 A 10/1976 McCullough
3,994,636 A 11/1976 McCullough et al.
4,340,339 A 7/1982 Hiraga et al.
4,415,317 A 11/1983 Butterworth
4,416,597 A 11/1983 Eber et al.
4,462,771 A 7/1984 Teegarden
4,718,836 A 1/1988 Pottier et al.
4,730,375 A 3/1988 Nakamura et al.
4,867,657 A * 9/1989 Kotlarek et al. ..... 418/55.5
4,892,469 A 1/1990 McCullough et al.
5,160,253 A 11/1992 Okada et al.
5,417,554 A * 5/1995 Kietzman et al. ..... 418/55.2
5,466,134 A 11/1995 Shaffer et al.
5,632,612 A * 5/1997 Shaffer ..... 418/55.4
5,752,816 A 5/1998 Shaffer
5,759,020 A 6/1998 Shaffer
5,951,268 A 9/1999 Pottier et al.
5,987,894 A * 11/1999 Claudet ..... 62/6
6,050,792 A 4/2000 Shaffer
6,129,530 A 10/2000 Shaffer
6,190,145 B1 * 2/2001 Fujioka et al. ..... 418/55.1
6,283,737 B1 * 9/2001 Kazakis et al. ..... 418/55.3

(Continued)

FOREIGN PATENT DOCUMENTS

JP 56019369 A * 2/1981 ..... H02K 23/04

*Primary Examiner* — Thomas Denion
*Assistant Examiner* — Laert Dounis
(74) *Attorney, Agent, or Firm* — Paul M Denk

(57) ABSTRACT

This gas equipment, for other than air, includes a fixed scroll and an orbiting scroll, each having fins upon their back surfaces. The orbiting scroll remains within a housing having fins that engage with the fins on the orbiting scroll. The internal fins of the housing transfer heat from the orbiting scroll to the housing for air cooling by the atmosphere. The spiral arranged fins pump working fluid within the housing to increase heat transfer. The housing may also have an exterior fan. The orbiting scroll receives torque and rotation from a magnetic coupling or magnetic face seal, without a physical connection to a motor, so that the atmosphere does not infiltrate inside the housing. The present invention also has an enclosed inlet plenum to prevent infiltration of the atmosphere into the working fluid.

7 Claims, 12 Drawing Sheets

(56) References Cited

U.S. PATENT DOCUMENTS

| | | | | |
|---|---|---|---|---|
| 6,379,134 | B2 | 4/2002 | Iizuka | |
| 6,439,864 | B1 | 8/2002 | Shaffer | |
| 6,511,308 | B2 | 1/2003 | Shaffer | |
| 6,905,320 | B2 * | 6/2005 | Satoh et al. | 418/55.1 |
| 7,306,439 | B2 * | 12/2007 | Unami et al. | 418/55.3 |
| 7,458,152 | B2 * | 12/2008 | Sato | 29/888.022 |
| 8,186,980 | B2 * | 5/2012 | Komai et al. | 418/55.3 |
| 8,328,544 | B2 * | 12/2012 | Iwano et al. | 418/55.3 |
| 2002/0071779 | A1 * | 6/2002 | Moroi et al. | 418/55.1 |
| 2007/0108934 | A1 * | 5/2007 | Smith et al. | 318/701 |
| 2007/0231174 | A1 * | 10/2007 | Ishizuki | 418/55.3 |
| 2011/0129362 | A1 * | 6/2011 | Kameya et al. | 417/228 |

* cited by examiner

SEMI-HERMETIC SCROLL COMPRESSORS, VACUUM PUMPS, AND EXPANDERS

CROSS-REFERENCE TO RELATED APPLICATION

This non-provisional patent application claims priority to the provisional patent application having Ser. No. 61/336,035, which was filed on Jan. 16, 2010, and which claims priority to the pending non-provisional patent application having Ser. No. 11/703,585 which was filed on Feb. 6, 2007 and which claims priority to the provisional patent application having Ser. No. 60/773,274, which was filed on Feb. 14, 2006 and the provisional application Ser. No. 60/773,274 was filed during the pendency of PCT application Serial No. PCT/US01/50377 which was filed on Dec. 31, 2001 designating the U.S., and which claimed priority to the U.S. non-provisional application Ser. No. 09/751,057 which was filed on Jan. 2, 2001 and is now U.S. Pat. No. 6,511,308.

BACKGROUND OF THE INVENTION

The semi-hermetic scroll compressors, vacuum pumps, and expanders relate generally to devices that alter or reduce the pressure of gases within a container, typically to very low vacuums. More specifically, these devices refer to internal housing fins and magnetic coupling usage that improve cooling and prevent the intrusion of atmospheric air within the housing and into the working fluid while the invention is strictly air cooled.

A unique aspect of the present invention is a closed housing for gases other than air that transfers heat from the housing without infiltration of gases into the housing during compression or expansion of the gas other than air within the housing.

Scroll devices have been used as compressors and vacuum pumps for many years. In general, they have been limited to a single stage of compression due to the complexity of two or more stages. In a single stage, a spiral involute or scroll upon a rotating plate orbits within a fixed spiral or scroll upon a stationery plate. A motor shaft turns a shaft that orbits a scroll eccentrically within a fixed scroll. The eccentric orbit forces a gas through and out of the fixed scroll thus creating a vacuum in a container in communication with the fixed scroll. An expander operates with the same principle only turning the scrolls in reverse. When referring to compressors, it is understood that expander or vacuum pump can be used.

Often oil is used during manufacture and operation of compressors. Oil free or oil less scroll type compressors and vacuum pumps have difficult and expensive manufacturing, due to the high precision of the scroll in each compressor and pump. For oil lubricated equipment, swing links often minimize the leakage from gaps in the scrolls by allowing the scrolls to contact the plate of the scroll. Such links cannot be used in an oil free piece of equipment because of the friction and wear upon the scrolls. If the fixed and orbiting scrolls in oil free equipment lack precision, leakage will occur and the equipment performance will decline as vacuums take longer to induce or do not arise at all.

Prior art designs have previously improved vacuum pumps, particularly the tips of the scrolls. In the preceding work of this inventor, U.S. Pat. No. 6,511,308, a sealant is applied to the scrolls during manufacturing. The pump with the sealant upon the scrolls is then operated which distributes the sealant between the scrolls. The pump is then disassembled to let the sealant cure. After curing the sealant, the pump is reassembled for use.

Then in U.S. Pat. No. 3,802,809 to Vulkliez, a pump has a scroll orbiting within a fixed scroll. Beneath the fixed disk, a bellows guides the gases evacuated from a container. The bellows spans between the involute and the housing, nearly the height of the pump. This pump and many others are cooled by ambient air in the vicinity of the pump.

In some applications, scroll type fluid displacement devices compress or expand gases other than air. Such applications include hydrogen recirculation pumps used in fuel cells, natural gas compressors used in micro-turbines, tritium vacuum pumps, Rankin cycle expanders, and the like. These applications call for a totally and completely enclosed housing so that the fluid undergoing compression or expansion does not leak from the housing into the nearby atmosphere or that the nearby atmosphere does not leak through the housing into the fluid undergoing compression or expansion. When compressing or expanding these fluids, heat arises in the various components of the present invention. The present invention though transfers heat from its fixed scroll and its orbiting scroll to the nearby atmosphere without leakage into the housing. Movement of the scrolls calls for transmission of power to the components of the invention also without leakage of the fluid undergoing compression or expansion.

The present art overcomes the limitations of the prior art where a need to exists for transmission of power and transfer of heat from a scroll fluid displacement device without leakage of a working fluid or infiltration of the atmosphere into the working fluid. That is, the art of the present invention, a semi-hermetic scroll device utilizes a magnetic coupling for power transfer and fins upon the orbiting scroll and inside the housing for heat transfer, both without leakage of the working fluid.

SUMMARY OF THE INVENTION

Accordingly, the present invention improves scroll compressors and other related equipment with a fixed scroll and an orbiting scroll each having fins upon their back surfaces and a housing having internal fins that engage those fins on the orbiting scroll and the atmosphere for heat transfer as the invention is strictly air cooled. The present invention also includes a fan outside the housing to accelerate heat transfer. The scrolls receive torque and rotation from a magnetic coupling or magnetic face seal so that the atmosphere does not infiltrate the housing. The present invention also has an enclosed inlet plenum to prevent mixture or infiltration of the working fluid into the heated fluid inside the housing. Alternatively, the fins are shaped as flat plate, spiral, or cylindrical. The spiral shaped fins inherently pump working fluid within the housing to increase heat transfer.

Therefore, it is an object of the present invention to provide new and improved compressors, vacuum pumps, and expanders for non-air gases.

It is a further object of the present invention to provide an enclosed housing of the orbiting and fixed scrolls.

It is a still further object of the present invention to provide air cooling of compressors thus increasing their efficiency.

It is an even still further object of the present invention to provide nested fins on the back of the orbiting scroll and the interior of the housing to transfer heat from the orbiting scroll to the housing and then to the ambient atmosphere.

It is a still further object of the present invention to provide a fan to move ambient air over the housing to accelerate heat transfer.

It is a still further object of the present invention to provide fins upon the scrolls that pump working fluid within the housing to increase heat transfer.

It is a still further object of the present invention to provide a magnetic coupling or magnetic face seal that separates the working fluid from the ambient atmosphere.

And, It is a still further object of the present invention to provide an enclosed inlet plenum that prevents mixing or infiltration of the working fluid into the heated fluid inside the housing.

These and other objects may become more apparent to those skilled in the art upon review of the invention as described herein, and upon undertaking a study of the description of its preferred embodiment, when viewed in conjunction with the drawings.

BRIEF DESCRIPTION OF THE DRAWINGS

In referring to the drawings,

FIG. 10 illustrates a sectional view of the front surface of the orbiting scroll generally opposite that of FIG. 9 and the orbiting scroll has an enclosed plenum there through;

The same reference numerals refer to the same parts throughout the various figures.

DESCRIPTION OF THE PREFERRED EMBODIMENT

Figure 1:
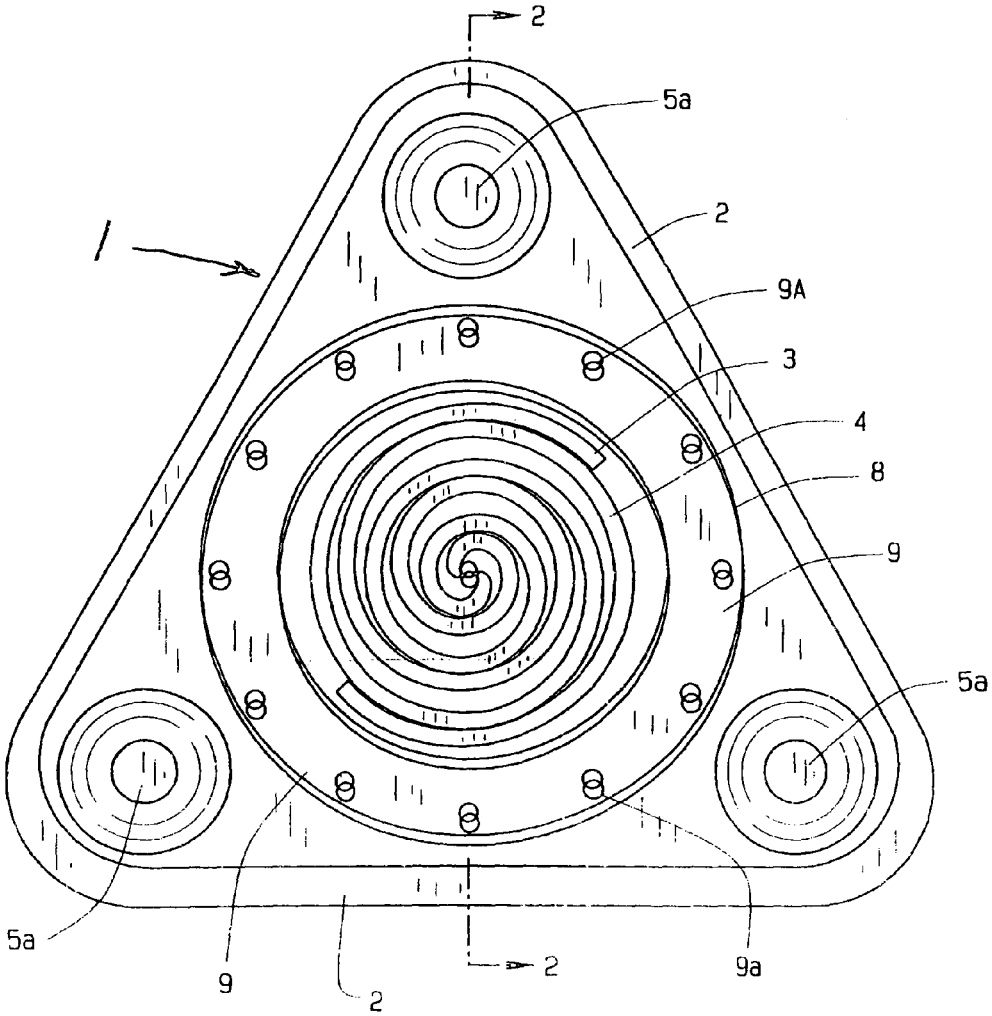
FIG. 1 shows a sectional view through both scrolls of a scroll compressor using an alternate embodiment of the present invention.

An alternate embodiment of the invention overcomes the prior art limitations by modifying scroll compressors and other pumps with bellows, liquid cooling using bellows, and tip seals. Turning to FIG. 1, a scroll compressor 1 appears in a sectional view through the scrolls. The scroll compressor 1 has a case 2 to contain the compressor 1 and scrolls. Within the case 2, the alternate embodiment of the invention has at least three equally spaced idlers 5*a*. The idlers rotate eccentrically in cooperation with the scrolls as the scrolls compress or evacuate a gas from a container, not shown. The scrolls are located within the idlers and intermesh. The scrolls have a fixed scroll 3 of a generally spiral shape fixed to the compressor 1 and an orbiting scroll 4 also of a generally spiral shape. The orbiting scroll 4 fits within the fixed scroll 3 and as the orbiting scroll 4 turns, gas is drawn into the scrolls and evacuated from the compressor 1. A bellows 8 surrounds and seals the scrolls while remaining flexible. The bellows 8 has two mutually parallel flanges 9, each flange 9 joined to a scroll. The bellows 8 has a hollow round cylindrical shape that extends around the circumference of the scrolls. The bellows 8 can be made of metal, plastic, polymer, or an elastomer among other things. Electro forming, hydro forming, welding, and casting among other means form and shape the bellows 8.

Figure 2:
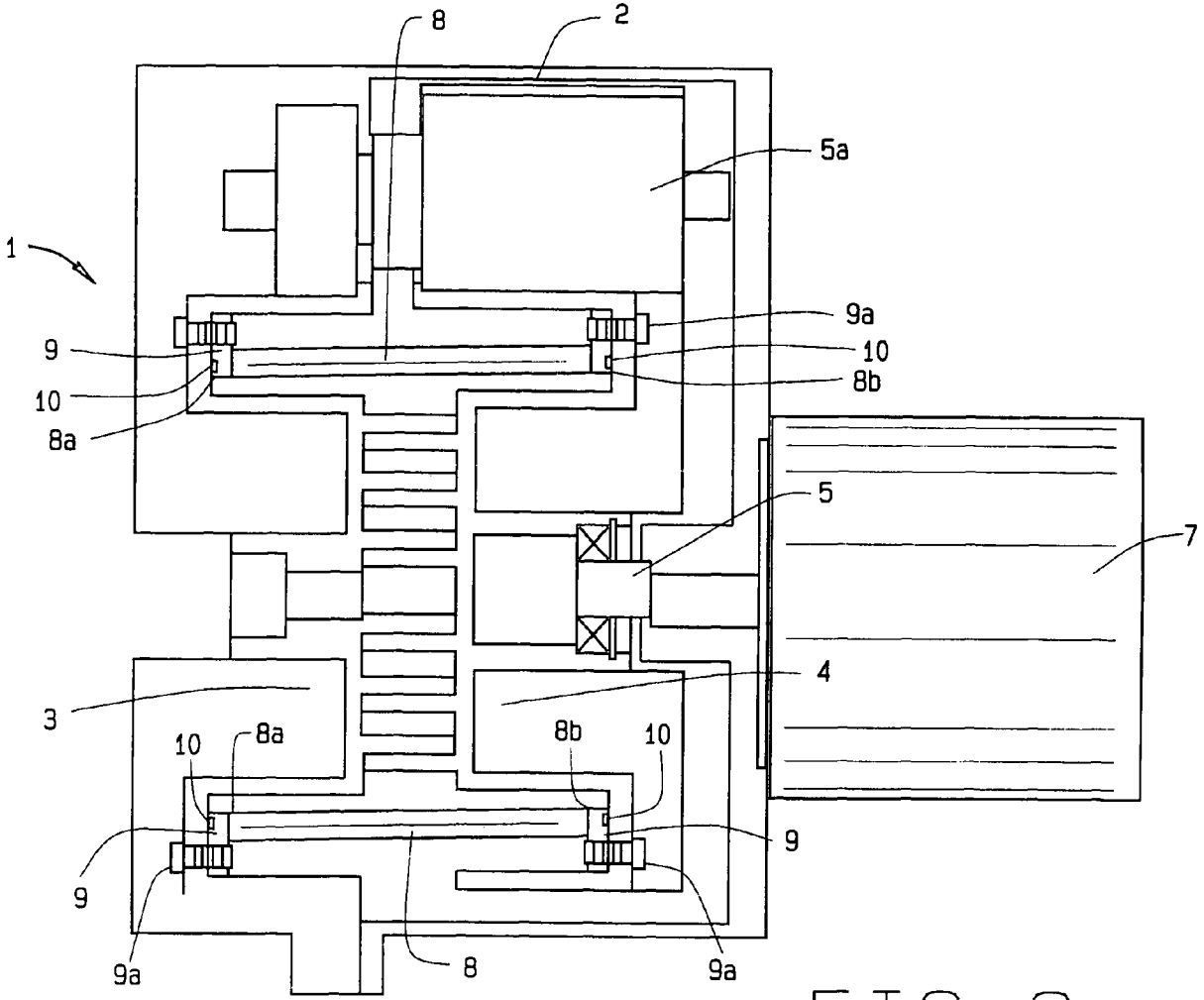
FIG. 2 shows a sectional view through a scroll compressor on a plane through the axis of rotation of the scrolls.

Turning a compressor 1 upon its side, FIG. 2 shows the workings of a compressor 1 in conjunction with a bellows 8. A motor 7 turns an axial shaft which connects with an eccentric shaft 5 that passes through a bearing. The eccentric shaft 5 connects with the orbiting scroll 4. The fixed scroll 3 is opposite the orbiting scroll 4 with an axis coaxial to the eccentric shaft 5. Operation of the motor 7 orbits the orbiting scroll 4 eccentrically which rotates the idlers and their attached counterweights. The idlers 5*a* have an offset shaft to guide the orbiting motion of the orbiting scroll 4. The idlers and counterweights permit eccentric rotation of the orbiting scroll 4 while preventing destruction of the scrolls and the compressors 1 due to centrifugal forces.

Outwards of the scrolls upon the perimeter, an annular well forms within the compressor 1. The well generally extends around the circumference of the scrolls and at least the height of the scrolls outwards from the centerline of the scrolls. Within the annular well, the bellows 8 seals the scrolls. The bellows 8 as before has a generally hollow cylindrical shape with a round flange 9 upon each end. Here in section, the bellows 8 appears on edge as two equally spaced bands. The bellows 8 has a slight inclination to accommodate the eccentric shaft 5. Flanges 9 appear upon each end of the bands and connect the bellows 8 by bolting or other means to the scrolls. The flanges 9 have an annular shape with an inner diameter similar to the inner diameter of the bellows 8. In the preferred embodiment, the flanges 9 bolt to the scrolls. In alternate embodiments, the flanges 9 join the scrolls by welding or brazing. To fully seal the scrolls, the flanges 9 have a sealing ring 10, within the seals 8*a* and 8*b*. Here in section, the sealing ring 10 appears as four portions located at the ends of each band. The sealing rings 10 take up any gap between the flanges 9 and the scrolls thus sealing the bellows 8. O-rings or metal seals may serve as the sealing rings 10.

Figure 3:
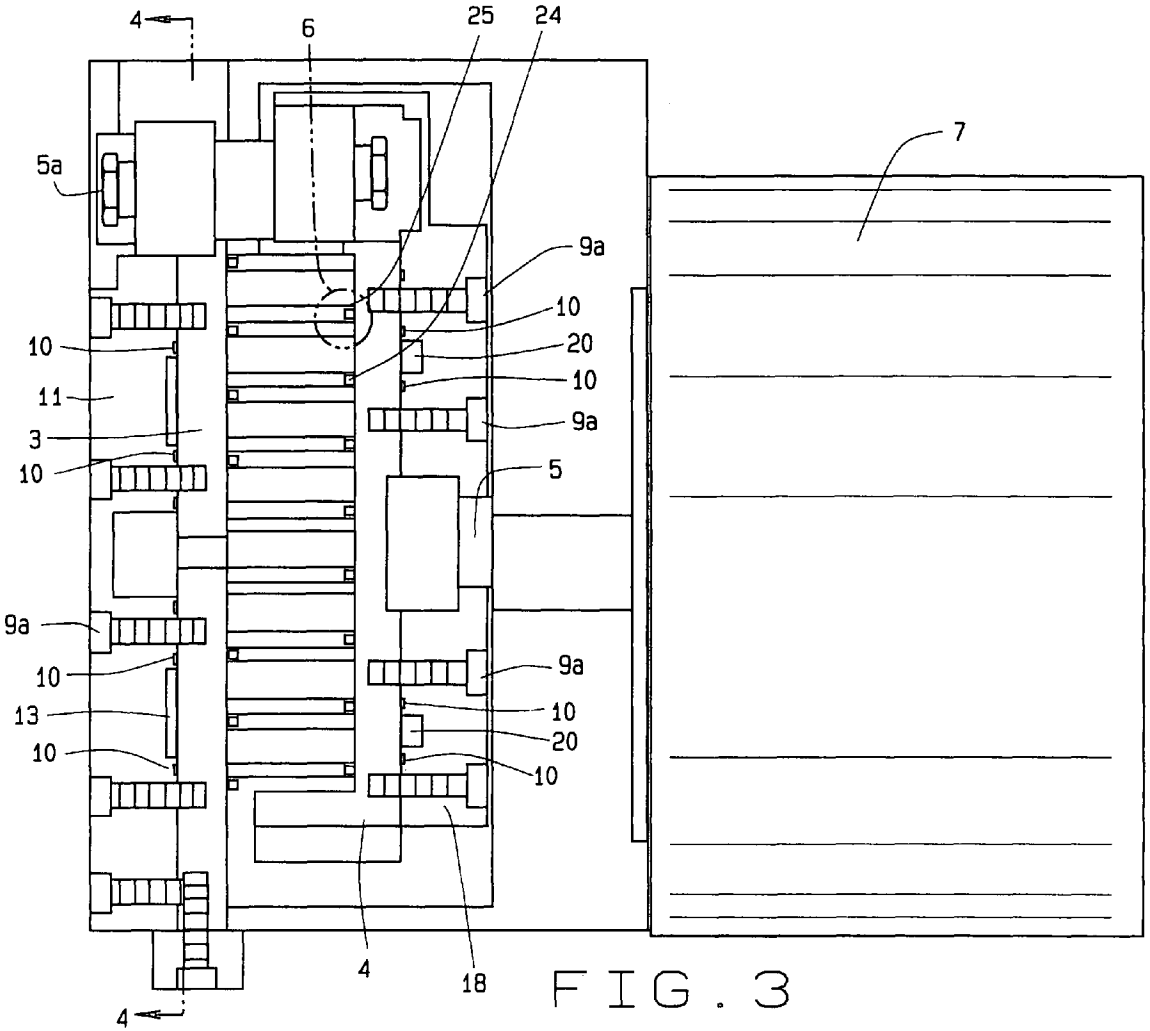
FIG. 3 describes a sectional view through a scroll compressor having liquid cooling.

Liquid cooling of a compressor 1 becomes possible for selected equipment and applications. Liquid cooling proves useful for compressors 1 in confined locations with limited access to air, such as boats or spacecraft. FIG. 3 shows the beginning of a liquid cooled compressor 1. As before, a motor 7 turns a shaft eccentrically connected to the scrolls. The alternate embodiment of the invention joins an orbiting cooling plate 18 to the orbiting scroll 4 and a fixed cooling plate 11 to the fixed scroll 3. The cooling plates join outwards from the scrolls so evacuation of gases continues unimpeded. The cooling plates have grooves 13, 20 upon their surfaces that form passages when joined against the scrolls. Liquid coolant then circulates through the passages and removes built up heat.

Figure 4:
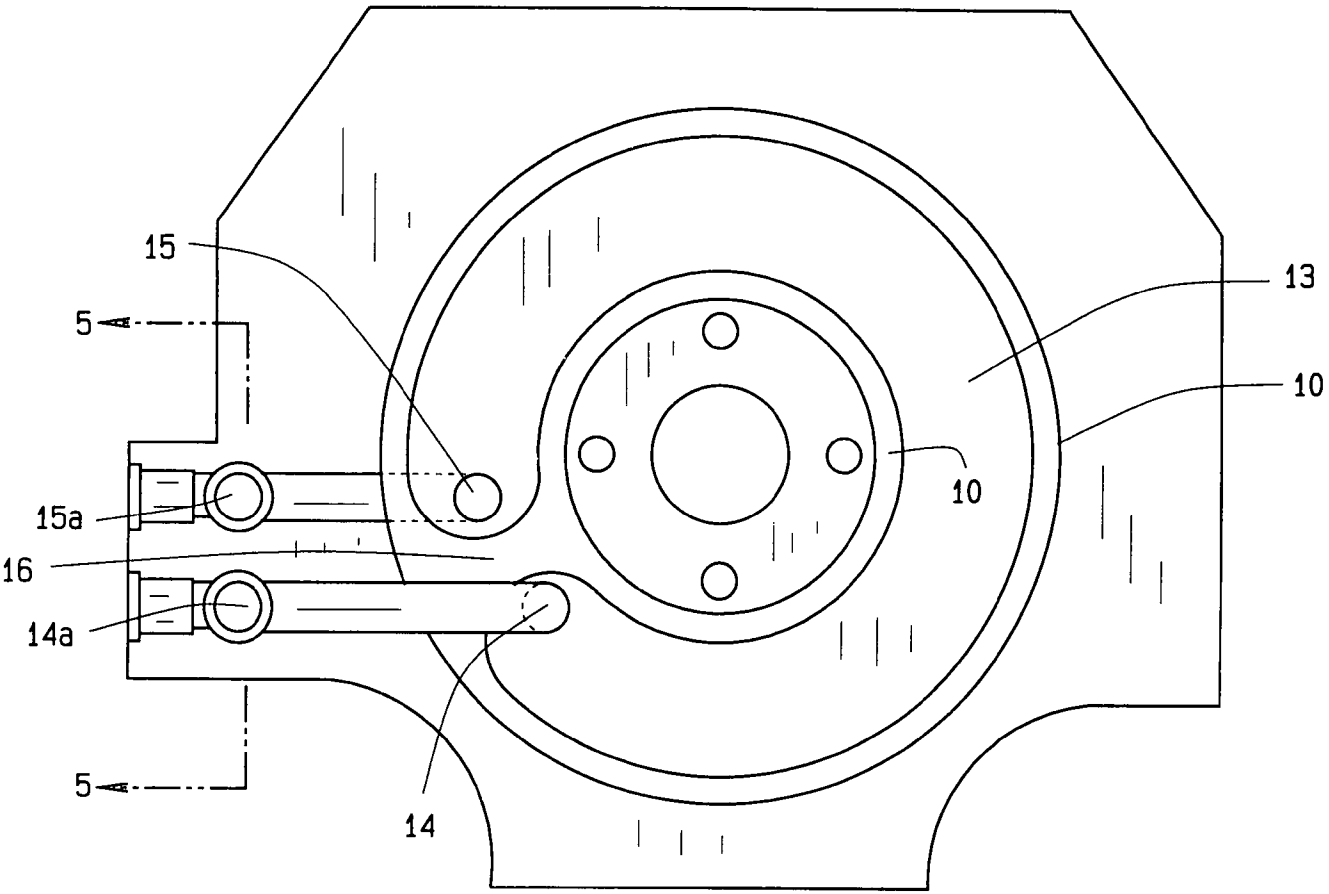
FIG. 4 describes a planar view of the cooling plate and its connection to the bellows of the alternate embodiment of the invention.

The grooves 13, 20 form a generally annular shape as shown in the sectional view of FIG. 4. The grooves 13 shown are in the fixed cooling plate 11 however the orbiting plate has similar grooves 20. The annular shape of the grooves 13 extends partially around the circumference and partially across the diameter of the fixed cooling plate 11. A wall 16 upon the fixed cooling plate 11 blocks the groove 13 from completely encircling the compressor 1. Proximate to the wall 16, the groove 13 has an aperture 14 in communication with an inlet for liquid coolant and on the other side of the wall 16, an aperture 15 in communication with an outlet to return the coolant for heat exchanging. O-rings 10 seal the inner and outer circumferences of the grooves 13 and apertures 14.

Figure 5:
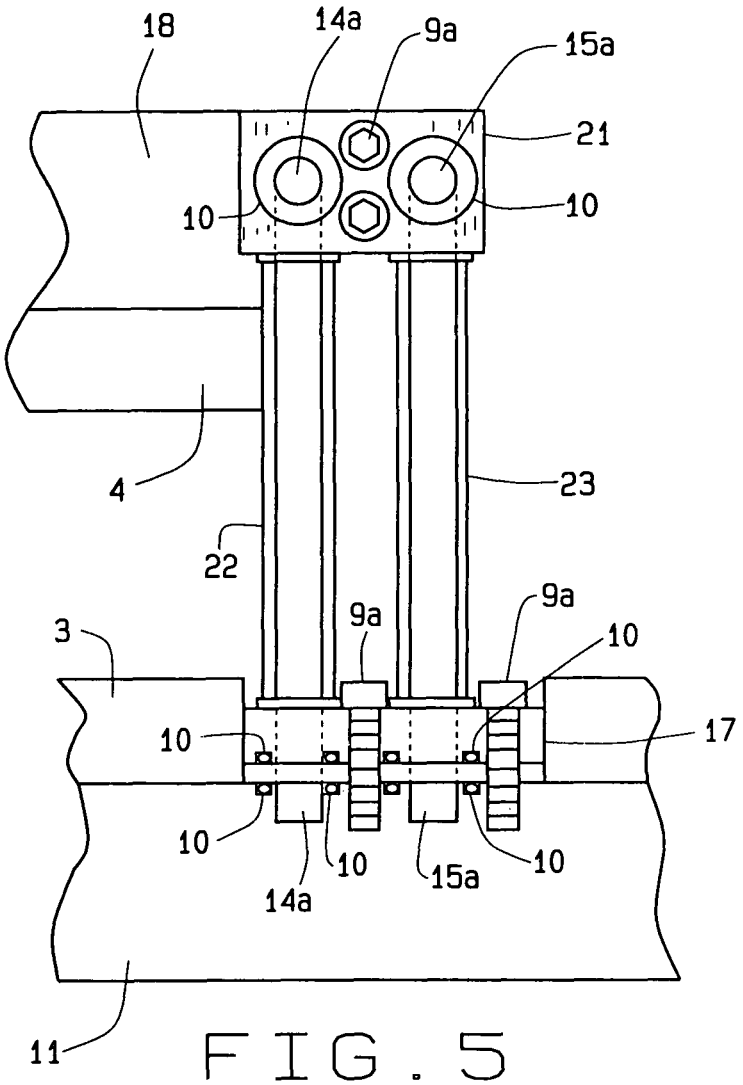
FIG. 5 illustrates a sectional view through the bellows and fittings for liquid cooling of a scroll compressor of the alternate embodiment of the invention.

Referencing the inlet and the outlet of FIG. 4, FIG. 5 shows a pair of bellows 22, 23 for conducting liquid coolant into and out of the orbiting scroll cooling plate for cooling the compressor 1 during operation. The cooling liquid is pumped into the inlet upon the fixed scroll cooling plate 11, through a port 14*a*, enters an aperture 14, and then travels through the passage 13 to cool the fixed scroll cooling plate 11. A portion of the cooling liquid travels through the first bellows 22 into the inlet aperture 14 upon the orbiting cooling plate 18. The portion of the cooling liquid then enters the passage 20 to cool the orbiting cooling plate 18. The cooling liquid portion then exits the outlet aperture 15 into the second bellows 23. The second bellows 23 also collects cooling liquid from the outlet aperture 15, through its port 15*a*, of the fixed scroll cooling plate 11. The second bellows 23 returns the generally heated cooling liquid from both cooling plates to the outlet for communication to a heat exchanger. The bellows 22, 23 have a hollow cylindrical shape with a flange upon each end sealed to the respective scrolls with sealing rings 10. The flanges join to the bellows by bolting preferably or alternatively by brazing or welding.

Upon the fixed scroll 3, the first bellows 22 and the second bellows 23 join to a first end plate 17. The first end plate 17 has a generally rectangular shape incorporated into the fixed scroll 3 and an upper surface and an opposite lower surface. The first end plate 17 bolts to the fixed scroll 3 in the preferred embodiment with the upper surface towards the orbiting scroll 4. Here the bolts 9*a* are located upon a line through the centers of the first bellows 22 and the second bellows 23. The first and second bellows join to the upper surface of the first end plate 17. Upon the lower surface, O-rings 10 seal fittings for the inlet and outlet of liquid coolant for the compressor 1. The O-rings 10 and fittings have a generally hollow round shape to ease connection of lines carrying the liquid coolant to and from the compressor 1.

Then upon the orbiting scroll 4, the first bellows 22 and the second bellows 23 join a second end plate 21. The second end plate 21 is fastened into the orbiting cooling plate 18, generally perpendicular to the first end plate 17. The second end plate 21 bolts to the orbiting cooling plate 18 with the bolts 9*a* upon the lateral axis of the second end plate 21, generally between the first and second bellows 23. O-rings 10 seal the first bellows 22 and the second bellows 23 to the second end plate 21.

Figure 6:
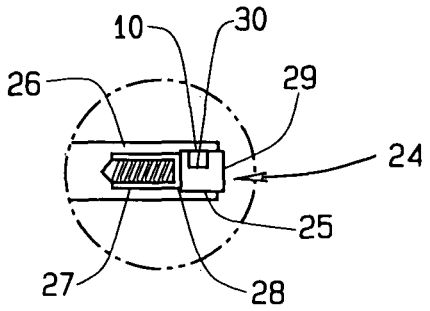
FIG. 6 shows a sectional view through one tip of a scroll having an improved seal of the alternate embodiment of the invention.

Turning to FIG. 6, the alternate embodiment of the invention modifies the tips 24 of the fixed scroll 3 and the orbiting scroll 4. Each scroll joins perpendicular to a plate. Opposite the plate, each scroll has a exposed tip 24 in a general spiral pattern. The tip 24 then has a groove 25 open away from the base. The groove 25 extends for the length of the scroll. A plurality of holes 26 is spaced along the length of the spiral. The diameter of each hole 26 is approximately the width of the groove 25. The alternate embodiment of the invention places into each hole a spring 27 upon a plunger 28, where the spring 27 biases against the plunger 28 outwardly. The plunger 28 has a diameter and shape slightly less than the hole 26. Upon the plunger 28 opposite the spring 27 and towards the tip 24 itself, a seal 29 abuts the opposing scroll. The seal 29 has a complementary shape to the hole 26. In an alternate embodiment, the seal 29 has a secondary O ring seal. The secondary O ring 10 extends in a groove 30 around the circumference of the seal 29. The spring 27 and the secondary O ring 10 prevent leakage between the scrolls as the seals 29 wear during use.

The modifications of this alternate embodiment also include a method of sealing the scrolls of a compressor 1. To attain high vacuums and maximum efficiency, imperfections and deviations in the scrolls must be sealed. Previously, epoxy was applied to the surfaces of the scrolls 3, 4, a compressor 1 was assembled and operated for a time, then the scrolls were disassembled and the tip seal grooves 25 cleaned, and then the epoxied scrolls were reassembled into a compressor 1. The alternate embodiment of the invention applies a mold release or other material upon the tips 24 of the scrolls for filling the tip seal groove 25, assembles the scrolls together, injects epoxy into the scrolls, then operates the compressor 1 for a time to disperse the epoxy. The mold release inhibits the adhesion and accumulation of epoxy upon the tips 24 thus reducing the need to disassemble, to clean, and then to reassemble the compressor 1. In the alternate embodiment of the invention, the epoxy occupies any gaps between the adjacent scroll's plate. The method of the alternate embodiment of the invention may eliminate the need for a tip seal 29 as previously described. In the preferred embodiment of this method, the mold release is a lubricating fluid. In an alternate embodiment, this method uses a mold release selected from elastomers, gels, greases, low hardness plastics, and pliable sealants. The method of the alternate embodiment of the invention applies to scroll compressors, vacuum pumps, and expanders alike.

Figure 7:
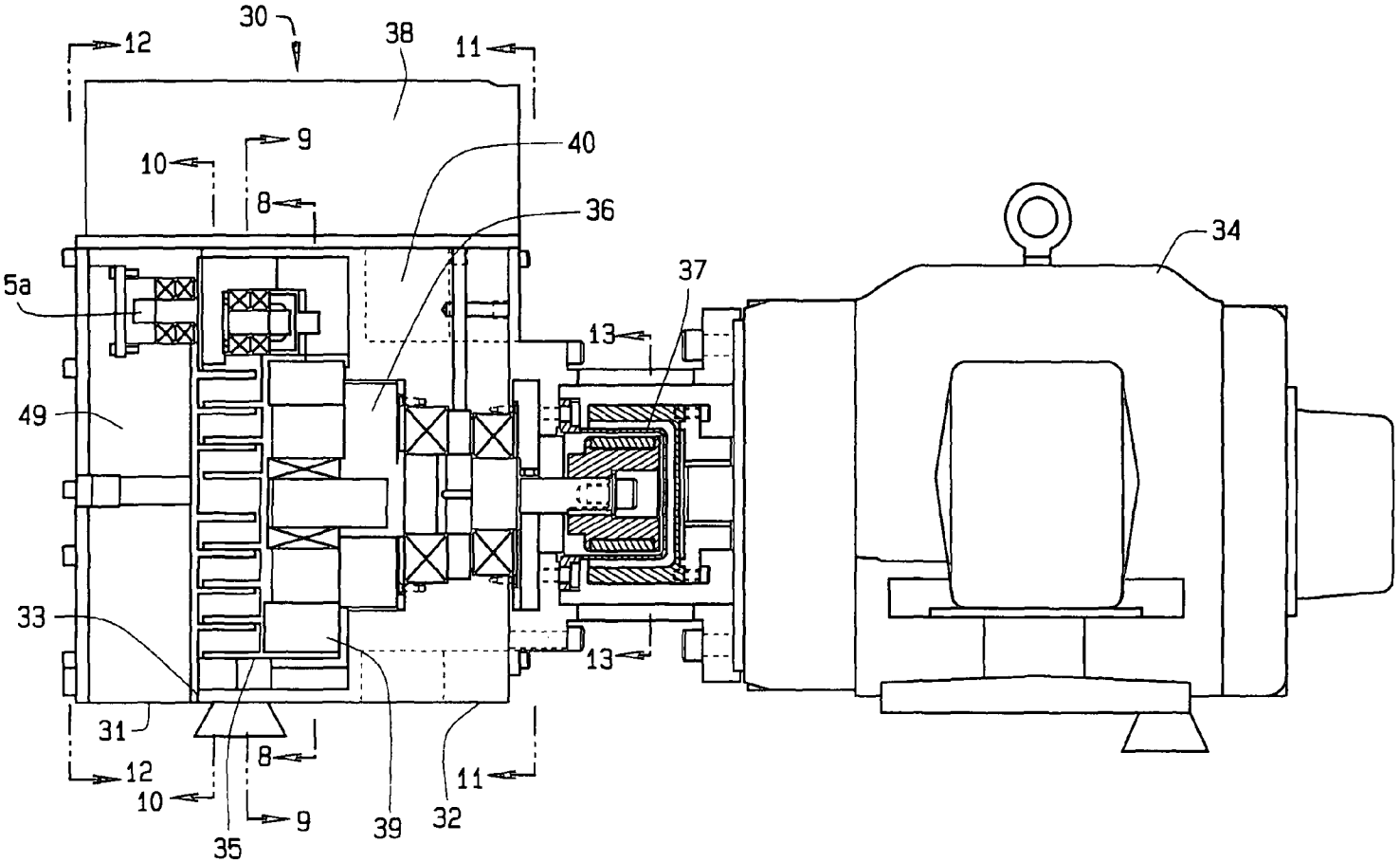
FIG. 7 shows a sectional view lengthwise through the housing of the present invention.

Now FIG. 7 shows the present invention of this application, a scroll type fluid displacement device that compresses or expands gases other than air. This invention can operate as hydrogen recirculation pumps used in fuel cells, natural gas compressors used in micro-turbines, tritium vacuum pumps, Rankin cycle expanders, and the like. These applications require a completely enclosed housing so that the fluid undergoing compression or expansion does not leak from the housing into the nearby atmosphere or that the nearby atmosphere does not leak through the housing into the fluid undergoing compression or expansion. The fluid undergoing compression or expansion for application outside the invention is called the working fluid. In the present invention, the housing includes cooling fluid contained within the housing. The working fluid and the cooling fluid are the same material in case of leakage within the housing. When compressing or expanding these working fluids, heat arises in the various components of the present invention. The present invention though transfers heat from its fixed scroll and its orbiting scroll to the nearby atmosphere without leakage into the housing. Movement of the scrolls calls for transmission of power to the components of the invention also without leakage of the fluid undergoing compression or expansion.

FIG. 7 shows a cross section of the scroll device 30 where a fixed scroll 31 is bolted to a housing 32. An O-ring 33 is positioned around the outside of the fixed scroll 31 and the housing 32 to seal the working fluid within the housing. The housing and the scrolls inside are coupled to a motor 34 here shown adjacent to the housing. The fixed scroll and an orbiting scroll 35 constitute the basic compressing, or alternatively expanding elements. An eccentric shaft 36 drives the orbiting scroll 35 during usage. Additionally, the eccentric shaft has a magnetic coupling 37, or alternatively a shaft seal, for transmitting the torque from the motor 34 into the orbiting scroll 35 for appropriate rotation without leakage of the working fluid to the atmosphere. Generally, the motor 34 supplies rotation to the magnetic coupling 37 which then imparts rotation and torque to the orbiting scroll 35 for usage as a compressor or vacuum pump while a generator supplies rotation to the orbiting scroll when the invention 30 is used as an expander. The fixed scroll 31, orbiting scroll 35, and housing 32 each have fins thereon, as later shown and described, for transferring heat primarily from the fixed and orbiting scrolls to the housing for evacuation by conduction or a fan 38 integrated into the housing.

Figure 8:
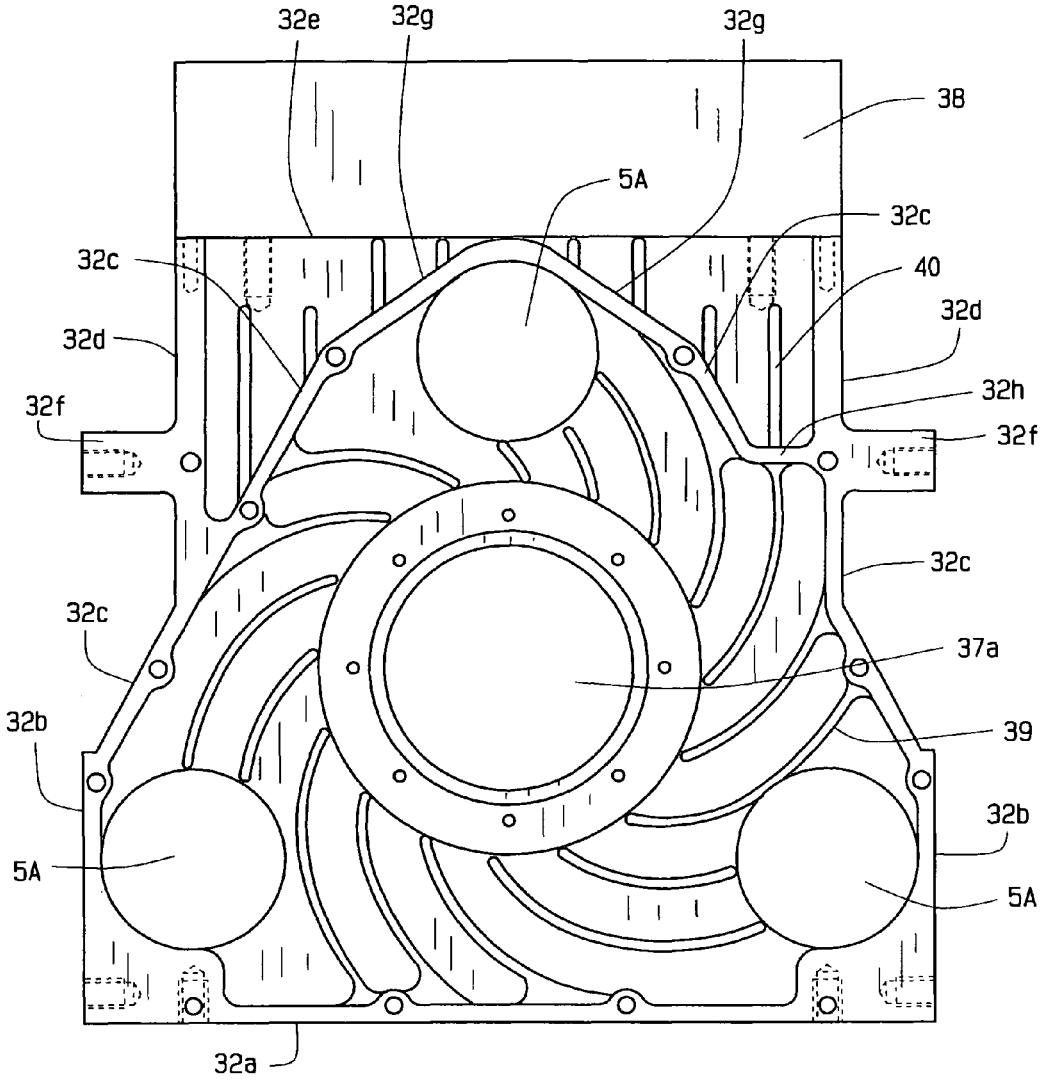
FIG. 8 provides a sectional view of the interior of the housing towards the motor.

FIG. 8 shows a sectional view of the interior of the housing 32 where the housing has internal fins 39 and external fins 40. The housing has a flat bottom 32*a*, two mutually parallel and spaced apart lower sides 32*b*, two inwardly canted middle sides 32*c*, two mutually parallel and spaced apart upper sides 32*d*, and an open top 32*e* generally spanning between the upper sides and mutually parallel to and spaced apart from the bottom. Upon each upper side, the housing has a tapped and threaded fitting 32*f* for receiving bolted devices, not shown. In the preferred embodiment, the internal fins have a generally spiral arrangement however, the internal fins may have alternate shapes of cylindrical or flat plate. The internal fins 39 extend from near the perimeter of the housing inwardly towards the opening 37*a* for the magnetic coupling 37. The internal fins have a generally arcuate shape where the end of the fin proximate the opening is generally ahead of the opposite end of the fin proximate the housing. This arcuate shape forms a generally clockwise spiral. The internal fins 39 are generally narrow in cross section and have a length of at least five times the cross section. The internal fins have a regular spacing between adjacent fins so that no internal fins intersect each other and the internal fins curve towards an imaginary center point at the center of the opening for the magnetic coupling.

The housing has a generally gambrel like shape with a flat bottom 32*a*, lower sides 32*b* perpendicular to the bottom, and inwardly canted middle sides 32*c*. The middle sides continue upwardly within the upper sides and have a section at a second cant 32*g* flatter than the remainder of the middle sides. The second cants 32*g* of the middle sides join upon the center line of the housing above an idler 5. Proximate one side, shown as the right in this figure, the middle side 32*c* extends inwardly and perpendicular to the upper side 32*d* as at 32*h* and there the second cant 32*g* of the middle side extends towards the uppermost idler 5*a*. Within the upper sides 32*d*, the upper middle sides 32*c*, the second cants 32*g*, and the top 32*e* and below the fan 38, the housing has the external fins 40. The external fins extend upwardly from the gambrel like portion of the housing, particularly from the upper middle sides and the second cants. The external fins are generally spaced apart and mutually parallel where the external fins are generally perpendicular to the bottom 32*a* and parallel to the upper sides 32*d*. Each external fin has a narrow cross section and an elongated form with a length in excess of twice the width of the fin.

Figure 9:
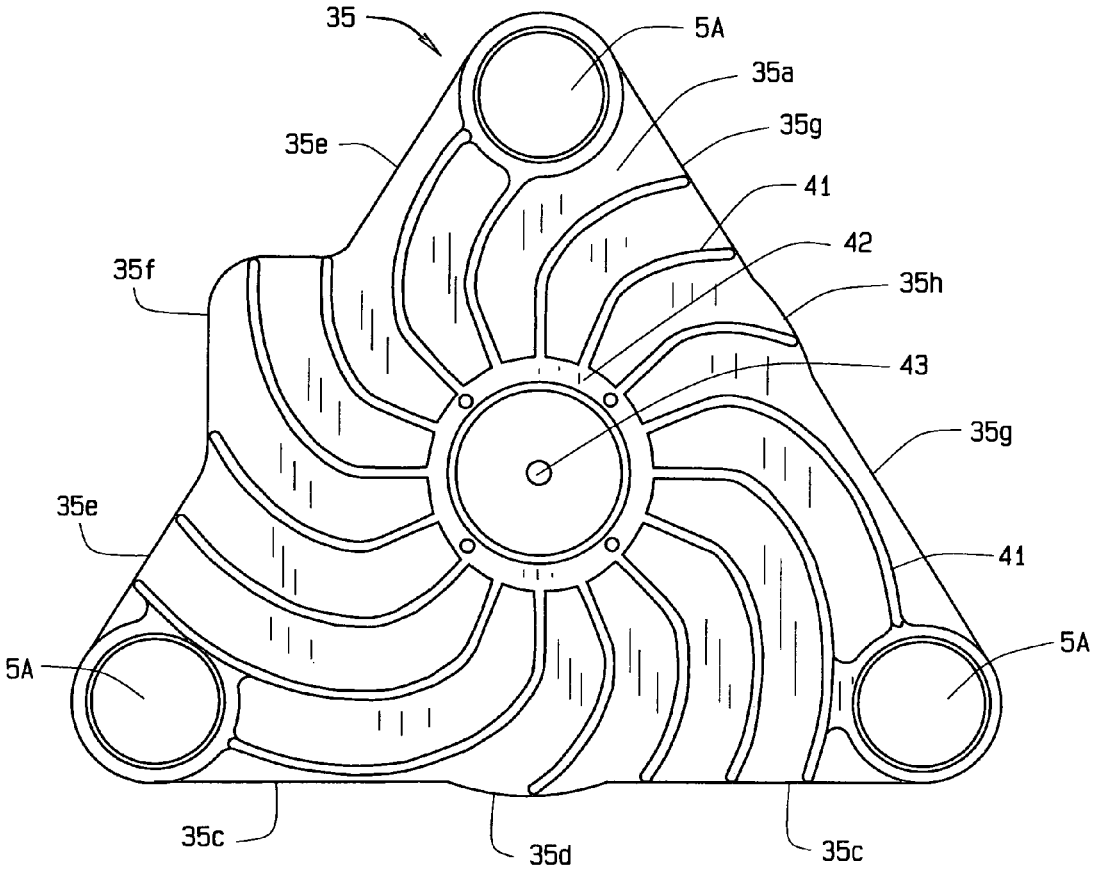
FIG. 9 provides a section view of the back surface of the orbiting scroll where the fins on this back surface engage the fins of the housing as in FIG. 8.

As described above, the housing has internal fins 39 arrayed in a spiral pattern. The internal fins of the housing mesh with the fins extending from the back of the orbiting scroll 35 as shown in FIG. 9. FIG. 9 shows a back face 35*a* of the orbiting scroll that engages the housing. The orbiting scroll has a generally triangular shape defined by the three idlers 5*a* installed at the vertices of the triangular shape. The orbiting scroll has a bottom 35*c* have a generally horizontal orientation, that is parallel to a supporting surface when the invention is installed as in FIG. 7. In the preferred embodiment, the bottom has a slight convex bulge 35*d* outwardly from the center of orbiting scroll. Proceeding clockwise, the orbiting scroll has a first leg 35*e* extending from above the idler 5 and inwardly from the left of the bottom as shown in this figure. The first leg proceeds upwardly and towards a centerline drawn perpendicular to the center of the bottom. The first leg 35*e* has an extension 35*f* outwardly from the orbiting scroll. The extension 35*f* has a rounded over corner defined by two edges mutually perpendicular with one edge perpendicular to the bottom and the other edge parallel to the bottom. The extension mates with the upper side 32*c* in a similar right angle shape as at 32 of the housing shown in FIG. 8. Above the extension and away from the bottom, the first leg continues to a vertex generally centered above the bottom. Continuing clockwise, at the vertex, the first leg 35*e* wraps around the idler 5 into the second leg 35*g*. The second leg extends from the vertex downwardly and outwardly towards the end of the bottom 35*c* here shown to the right of the figure. Approximately centered along the length of the second leg, another slight convex bulge extends outwardly as at 35*h*. The first leg attains an approximately 60° angle to the bottom, the second leg attains an approximately 60° angle to the first leg, and the bottom attains approximately 60° angle to the second leg.

Upon the back face 35*a*, the orbiting scroll 35 has a plurality of fins 41 arrayed thereon. The fins extend outwardly from an imaginary center of the orbiting scroll towards the bottom, the first leg, and the second leg. Each fin has a narrow cross section and an elongated shape with a length of at least three times the width of the fin. In the preferred embodiment, the internal fins have a generally spiral arrangement however, the internal fins may have alternate shapes of cylindrical or flat plate. These fins 41 extend from near the perimeter, that is the bottom, first leg, and second leg, of the orbiting scroll inwardly towards a circular ring 42 that has an inside diameter proportional to that of the magnetic coupling. The circular ring has at least three holes for securement of the orbiting scroll to the magnetic coupling. These fins 41 have a generally arcuate shape where the end of the fin proximate the circular ring is generally ahead of the opposite end of the fin proximate the perimeter of the orbiting scroll. Proximate the ring 42, each fin approaches the imaginary center of the orbiting scroll upon a radial line. This overall arcuate shape of each fin forms a generally counter-clockwise spiral in this view. These fins 41 have a regular radial spacing between adjacent fins so that fins do not intersect each other. These fins 41 and the internal fins 39 of the housing have sufficient spacing between them to permit motion of the orbiting scroll during usage but without contact between these fins 41 and the internal fins 39. Generally in the center of the ring 42, the orbiting scroll has a plenum 43 here shown on end. The plenum admits working fluid as an internal coolant into the gaps between the orbiting scroll fins 41 and the internal fins 39 of the housing. The plenum provides fluid communication between the back face 35*a* and the front face 35*b* of the orbiting scroll.

Figure 10:
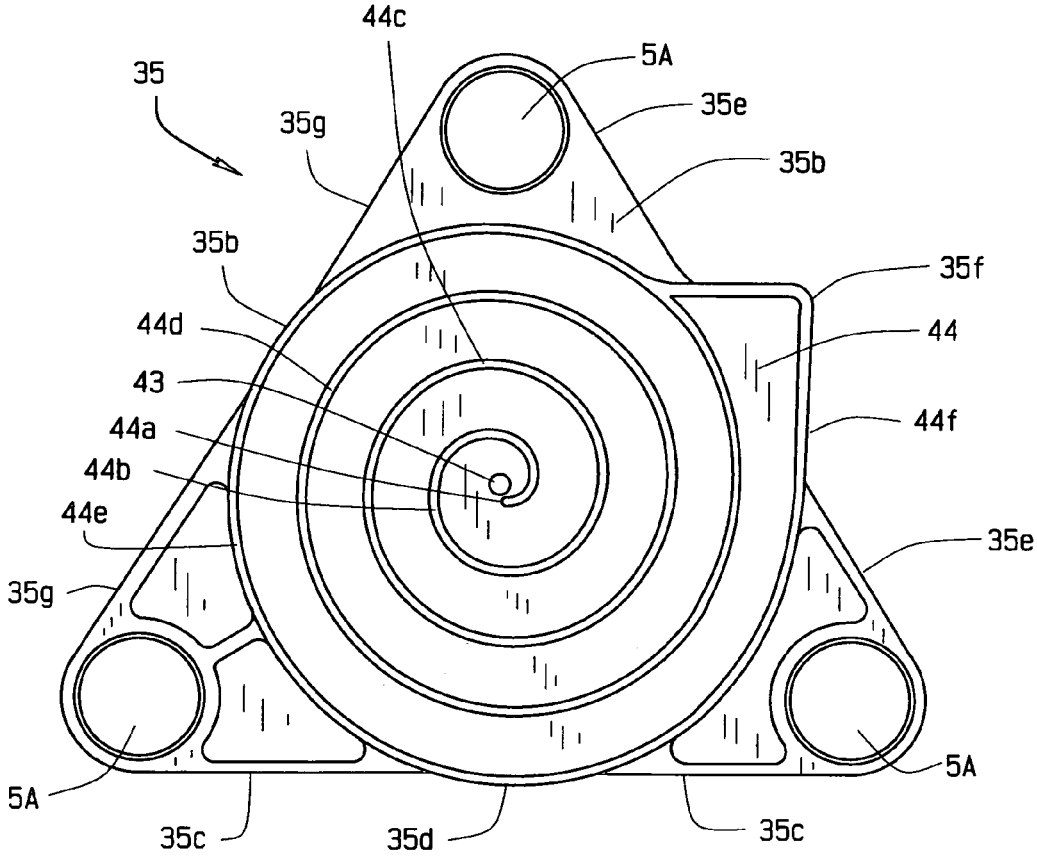

FIG. 10 then shows front face 35*b* an orbiting scroll with an enclosed plenum 43 that prevents the working fluid from mixing with the cooling fluid in the housing 32. The present invention generally operates where the working fluid and the cooling fluid are the same. Usage of similar fluids accommodates any leakage across the seal of the enclosed plenum 43. Alternatively, the enclosed plenum can be incorporated with the fixed scroll 31, similar to the bellows 22, 23 as previously shown in FIGS. 4, 5. As before, the orbiting scroll has a generally triangular shape defined by the three idlers 5*a* installed at the vertices of the triangular shape. The orbiting scroll has a bottom 35*c* have a generally horizontal orientation, that is parallel to a supporting surface when the invention is installed. In the preferred embodiment, the bottom has a slight convex bulge 35*d* outwardly from the center of orbiting scroll. Proceeding clockwise which is generally opposite that of FIG. 9, the orbiting scroll has the second leg 35*g* that proceeds upwardly and towards a centerline drawn perpendicular to the center of the bottom. Approximately centered along the length of the second leg, another slight convex bulge extends outwardly as at 35*h*. The second leg extends inwardly from the left of the bottom as shown in this figure. The second leg continues to a vertex of the triangular shape generally above the center of the bottom. Continuing clockwise, at the vertex, the second leg 35*g* wraps around the idler 5 into the first leg 35*e*. The first leg 35*e* extends from above the idler 5, downwardly and outwardly towards the right end of the bottom in this figure. The first leg 35*e* has its extension 35*f* outwardly from the orbiting scroll. The extension 35*f* has a rounded over corner defined by two edges mutually perpendicular with one edge perpendicular to the bottom and the other edge parallel to the bottom. The extension mates with the upper side 32*c* in a similar right angle shape as at 32 of the housing previously shown in FIG. 8. The first leg, the second leg, and the bottom each attain approximately 60° angles relative to each other at each vertex of the orbiting scroll. The front face of the orbiting scroll also includes a spiral involute 44. The involute has a generally narrow cross section, an elongated length, and a spacing away from the surface of the front face, generally opposite the internal fins of the back face. The involute begins tangent to the plenum opening, as at 44*a*, generally parallel to the bottom. The involute then curves at a constantly increasing radius as it wraps around the front face. Here the involute completes more than four wraps, 44*b*, 44*c*, 44*d*, 44*e*, to around the plenum where each successive wrap has a greater diameter. The involute, in the fourth wrap 44*e* then extends perpendicular to the bottom as at 44*f*. This extension of the involute fits within the right angle shape 32*c* of the housing upon the first leg as previously described. The radius of the fourth wrap 44 also exceeds the distance from the center of the plenum to the nearest side. Thus, the fourth wrap of the involute extends slightly from the orbiting scroll and occupies the convex bulge 35*d* of the bottom and the convex bulge 35*h* of the second leg.

Figure 11:
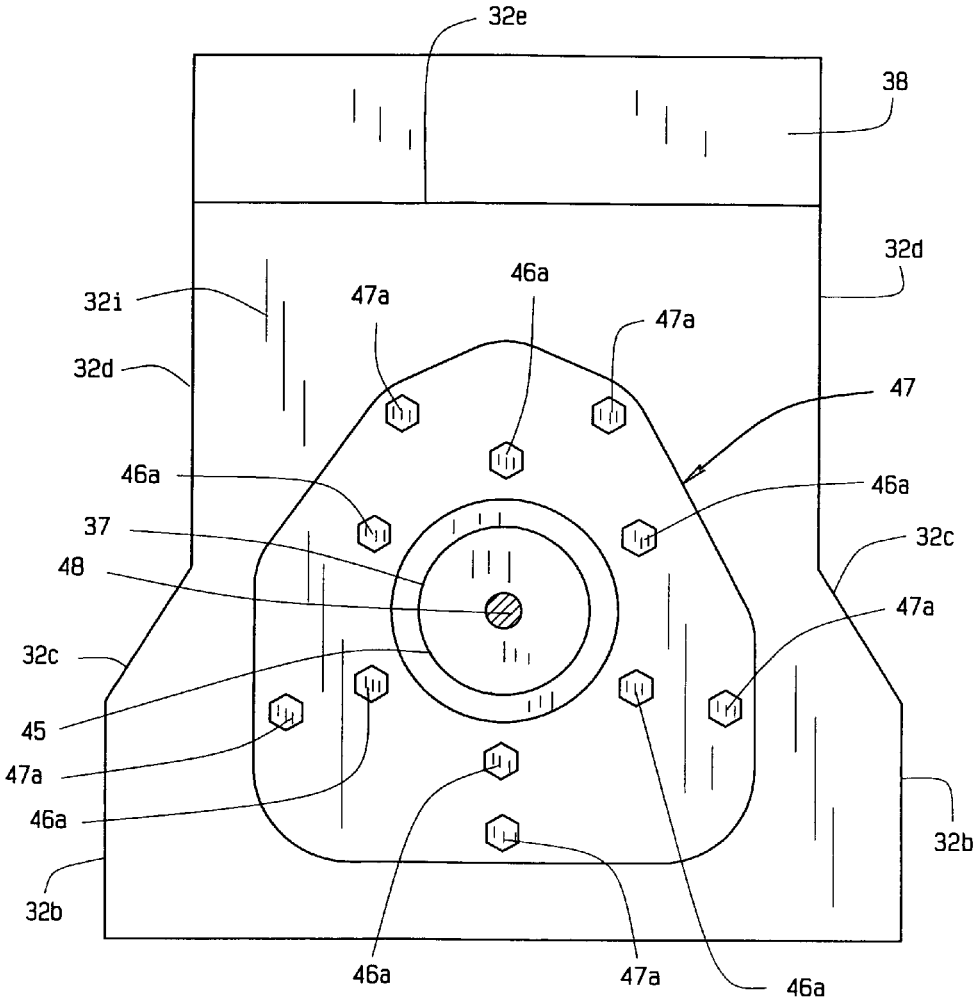
FIG. 11 describes an end view of the housing adjacent to the motor.

FIG. 11 shows the housing 32 upon an end 32*i* that faces the motor 34. The housing has its bottom 32*a*, lower sides 32*b*, middle sides 32*c*, upper sides 32*d*, and top 32*e* as previously described. The fan 38 rests upon the top 32*e* and draws air up, through, and around the housing for air cooling. The end has a generally smooth face. Generally centered between the middle sides, the housing receives an inner rotor 45 concealed within a stationary can 46 of the magnetic coupling 37 as later shown in FIG. 13. The inner rotor then transmits rotation to a compressor shaft 48 that joins to the back surface of the orbiting scroll. Here in FIG. 11, the magnetic coupling has a sealed shroud 47 that has a generally gambrel shape similar to that of the housing but of a lesser scale. The shroud bolts to the exterior surface of the housing, generally opposite the back surface 35*a* of the orbiting scroll as in FIG. 7. The shroud has approximately five bolted connections, as at 47*a*, that secure the shroud to the housing. Within the shroud, the stationary can 46 secures to the housing approximately six bolted connections as at 46*a*. Both the bolted connections 47*a* of the shroud and the bolted connections 46*a* of the can are mutually parallel and generally parallel to the axis of rotation of the inner rotor 45. The motor 34 generates rotation and torque from its shaft as at 34*a*. The motor shaft 34*a* then drives the magnetic coupling to rotate. The coupling rotates thus transmitting the rotation and torque from the motor shaft into the compressor shaft 48 without a physical connection between the motor shaft and the compressor shaft as later shown.

Figure 12:
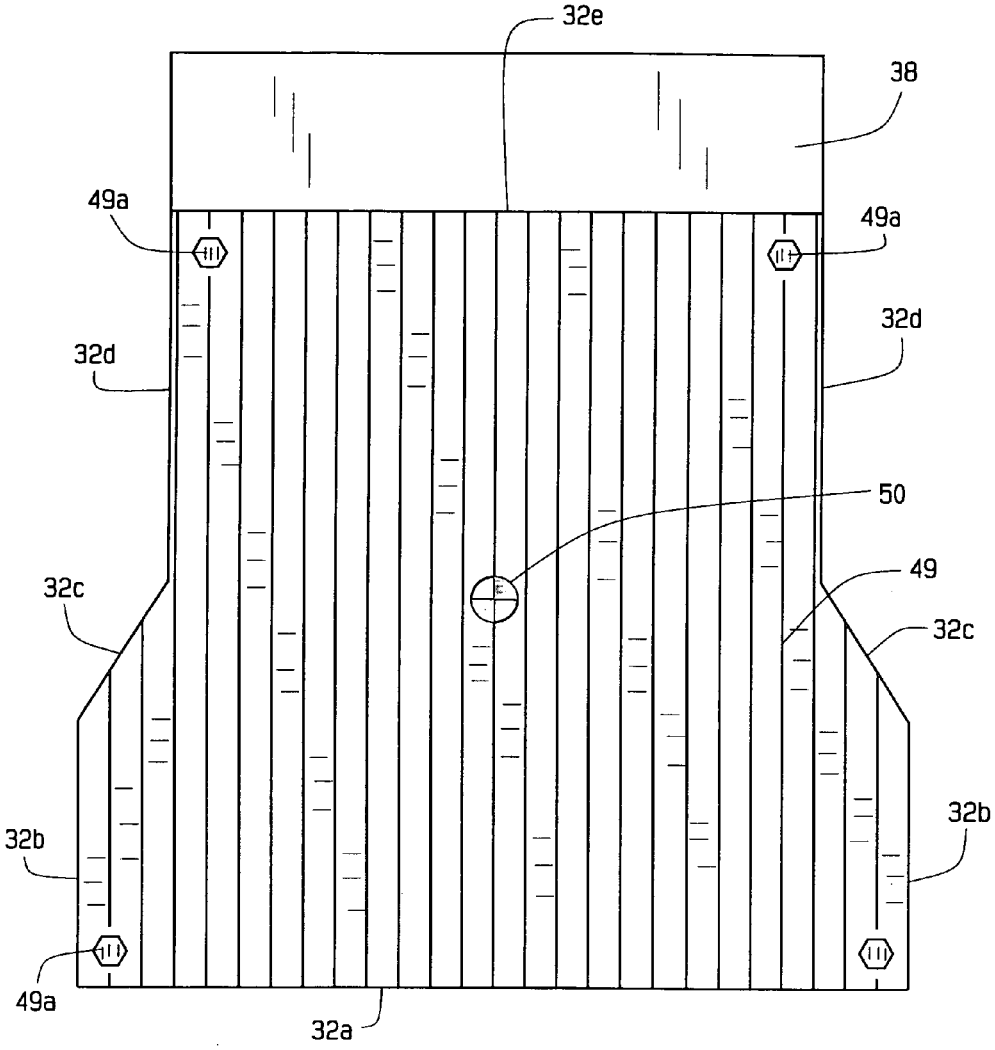
FIG. 12 describes an end view of the housing away from the motor, generally opposite that of FIG. 11; and, FIG. 13 shows a detailed sectional view of the magnetic coupling between the motor and the orbiting scroll within the housing.

Turning to the opposite end of the housing as in FIG. 11, FIG. 12 shows the housing end, as at 49, opposite from the motor 34. As previously described, the housing has its bottom 32*a*, lower sides 32*b*, middle sides 32*c*, upper sides 32*d*, and top 32*e* generally in a mirror image as that of FIG. 11. The fan 38 rests upon the top 32*e* and draws air to cool the housing. This end also has a generally smooth face. This end 49 secures to the remainder of the housing use bolted connections as at 49*a* in at least four locations, approximately as shown. Somewhat centered on this end 49, the end has a bearing 50 that receives a shaft from the fixed scroll.

Figure 13:
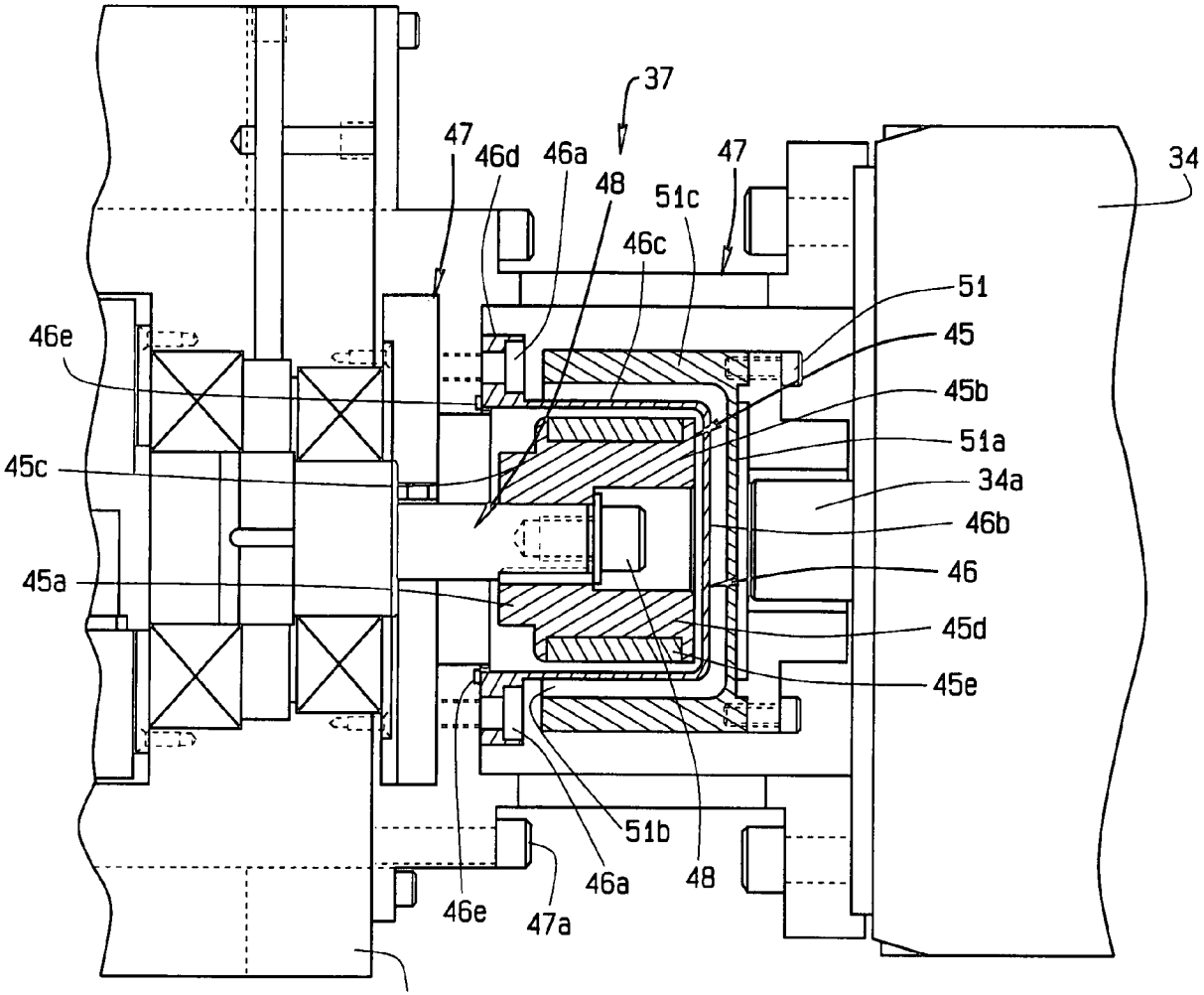

As mentioned briefly in FIG. 11, the motor 34 delivers rotation and torque to the orbiting scroll through a magnetic coupling 37 shown in a section view in FIG. 13. The coupling transmits rotation and torque from the motor shaft 34*a* to the compressor shaft 48 without a physical connection between the two shafts. Rather the coupling uses a magnetic field put into rotation to transmit rotation and torque from one shaft to another. Because the magnetic field penetrates steel and plastic, the coupling transmits rotation and torque between the shafts while the compressor shaft remains sealed within the stationary can 46. Sealing the compressor shaft retains the airing fluid and the working fluid within the housing 32 and prevents intrusion of the atmosphere along the compressor shaft into the housing. As before, the magnetic coupling 37 has a shroud 47 that extends between the motor 34 and the housing 32 and enwraps the coupling. The shroud bolts on its own opposite ends to both the motor and the housing as shown and described. Inside the shroud 47, the motor extends its shaft 34*a* within the shroud towards the adjacent housing.

The shaft has secured to it an outer rotor 51 here shown as a generally U shape in section view. The outer rotor has a generally round cylindrical shape with a closed end 51*a* adjacent to the shaft 34*a* and an opposite open end as at 51*b* proximate the housing. The outer rotor has a generally curved wall 51*c* extending perpendicular to the perimeter of the closed end. The outer rotor has its own magnetic polarity and its own inside diameter.

Inside of the outer rotor, the magnetic coupling has a stationary can 46 that secures to the housing 32 through its bolts as at 46*a*. The stationary can is also a generally round cylinder, shown here as a U shape in section view, with a closed end 46*b*, an opposite open end 46*c*, and a thin wall 46*c* that expands outwardly into a flange 46*d* for receiving bolts 46*a* adjacent to the housing. The stationary can also includes an O-ring or gasket as at 46*e* upon its circumference upon the interior of the flange 46*d* that seals the stationary can upon the housing and prevents intrusion of the atmosphere into the housing. The stationary can has an outside diameter less than the inside diameter of the outer rotor and limited effect on the magnetic field of the outer rotor.

And then inside of the stationary can, the magnetic coupling has its inner rotor 45 generally coaxial with the compressor shaft and mechanically secured to the compressor shaft. The inner rotor is a somewhat round cylinder with a recess at its base, here shown as a thickened U shape with an extension at the base of the U shape. The inner rotor has an open end 45*b* and an opposite closed end 45*a* with an extension 45*c* recessed in from the wall 45*d* forming the inner rotor. The wall 45*d* is generally thick, much thicker in comparison to the walls of the stationary can and the outer rotor. In the preferred embodiment, the entire inner rotor has a magnetic polarity opposite that of the outer rotor. The opposite polarities attract the inner rotor to rotate in the direction of the outer rotor. Alternatively, the inner rotor is magnetically neutral and includes a magnetic band 45*e* around the perimeter of the inner rotor and extend for substantially the length of the wall 45*d*. The magnetic band has an opposite magnetic polarity to the outer rotor. The inner rotor has an outer diameter less than the inside diameter of the stationary can. So, turning of the outer rotor by the motor causes the inner rotor to turn in the same direction through magnetic attraction without a physical connection of the motor shaft to the compressor shaft. Additionally because the motor turns magnetized parts within the magnetic coupling, the housing, the motor, and the coupling are grounded to dissipate any electrical charge created by the rotating magnetic parts.

From the aforementioned description, semi-hermetic scroll compressors, vacuum pumps, and expanders have been described. These semi-hermetic devices are uniquely capable of compressing or expanding a working fluid without intrusion of the nearby atmosphere. During operation, these devices generate heat within their fixed and orbiting scrolls which is dissipated through cooperating fins upon the surrounding housing. These devices also receive their power from a motor connected by a magnetic coupling, further minimizing the incidence of atmospheric intrusion within the housing and the working fluid. The present invention and its various components adapt existing equipment and may be manufactured from many materials including but not limited to metal sheets and foils, elastomers, steel plates, polymers, high density polyethylene, polypropylene, polyvinyl chloride, nylon, ferrous and non-ferrous metals, their alloys, and composites.

I claim:

1. A device separating a working fluid from a cooling fluid within a housing having a fixed scroll enmeshed with an orbiting scroll, said orbiting scroll driven by an eccentric shaft, a motor driving said device, and a housing containing said fixed scroll and said orbiting scroll, the device further comprising:

said orbiting scroll having a front surface and an opposite back surface, said front surface having a plurality of spiral fins thereon engaging said fixed scroll and said back surface having a plurality of fins thereon;

an orbiting cooling plate on the back surface of the orbiting scroll, the orbiting cooling plate having a groove forming a passage for circulation of a liquid coolant to remove any built up heat;

a fixed cooling plate on the fixed scroll, the fixed cooling plate having a groove forming a passage for circulation of a liquid coolant to remove any built up heat;

said housing having a plurality of fins therein, said fins of said housing fitting within said fins upon said back surface of said orbiting scroll wherein heat transfers from said orbiting scroll to said housing and wherein said housing is air cooled;

said device including an enclosed plenum, said plenum extending from the center of said orbiting scroll axially outwardly of said device, said plenum preventing infiltration of working fluid with heated fluid inside said housing;

a magnetic connection between said motor and said device, said magnetic connection transmitting rotation of said torque from said motor to said device therein driving said eccentric shaft causing said orbiting scroll to orbit;

said housing having an interior surface towards said motor, said interior surface having said plurality of fins locating thereon;

said plurality of fins upon said orbiting scroll are one of flat, spiral, and cylindrical;

said plurality of fins upon said interior surface of said housing are one of flat, spiral, and cylindrical cooperating with said plurality of fins upon said orbiting scroll in removing heat from said device to the atmosphere;

said plurality of fins upon the front and back surfaces of said orbiting scroll being spiral shaped, and said plurality of fins upon said interior of said housing being spiral shaped in cooperation with said plurality of fins upon said orbiting scroll wherein said plurality of fins inherently pump the working fluid within the housing to increase heat transfer from said device;

said magnetic connection between said motor and said device being one of a magnetic coupling and magnetic face seal;

said motor having a shaft extending outwardly from said motor and said device having a shaft in connection to said orbiting scroll and extending outwardly from said device;

said magnetic connection between said motor and said device being a magnetic coupling; and said magnetic coupling including a shroud, being hollow and connecting said motor to said device, an outer rotor having magnetic polarity, a stationary can within said outer rotor connecting to said housing, said stationary can lacking a magnetic polarity, and an inner rotor within said stationary can connecting to said shaft of said device, said inner rotor having a magnetic polarity opposite that of said outer rotor.

2. The device separating a working fluid from a cooling fluid within a housing of claim 1 further comprising:

said inner rotor lacking a magnetic polarity and having a band upon the circumference of said inner rotor, said band having a magnetic polarity opposite that of said outer rotor.

3. The device separating a working fluid from a cooling fluid within a housing of claim 1 further comprising:

at least one fan upon said housing, said fan adapted to move atmospheric air over said housing, accelerating heat transfer from said device to the atmospheric air.

4. The device separating a working fluid from a cooling fluid within a housing of claim 1 further comprising:

said housing having an exterior surface, said exterior surface including fins thereon accelerating the transfer of heat from said housing to the atmospheric air.

5. A device for separating a working fluid from a cooling fluid within a housing having a fixed scroll enmeshed with an orbiting scroll, said orbiting scroll driven by an eccentric shaft, a motor driving said device, and a housing containing said fixed scroll and said orbiting scroll, the device further comprising:

said orbiting scroll having a front surface and an opposite back surface, said front surface having a plurality of spiral fins thereon engaging said fixed scroll and said back surface of said orbiting scroll having a plurality of fins thereon;

an orbiting cooling plate on the back surface of the orbiting scroll, the orbiting cooling plate having a groove forming a passage for circulation of a liquid coolant to remove any built up heat;

a fixed cooling plate on the fixed scroll, the fixed cooling plate having a groove forming a passage for circulation of a liquid coolant to remove any built up heat;

said housing having a plurality of fins therein, said fins of said housing fitting within said fins upon said back surface of said orbiting scroll wherein heat transfers from said orbiting scroll to said housing and wherein said housing is air cooled;

said housing having an interior surface towards said motor, said interior surface having a plurality of fins locating therein;

said plurality of fins upon the front and back surfaces of said orbiting scroll being spiral shaped, and said plurality of fins upon said interior of said housing being spiral shaped in cooperation with said plurality of fins upon said orbiting scroll wherein said plurality of fins inherently pump the working fluid within the housing to increase heat transfer from said device to the atmosphere;

said device including an enclosed plenum, said plenum extending from the center of said orbiting scroll axially outwardly of said device, said plenum preventing infiltration of working fluid with heated fluid inside said housing;

said motor having a shaft extending outwardly from said motor and said device having a shaft in connection to said orbiting scroll and extending outwardly from said device;

a magnetic connection between said motor and said device, said magnetic connection transmitting rotation and torque from said motor to said device therein driving said eccentric shaft causing said orbiting scroll to orbit;

said magnetic coupling including a shroud, generally hollow and connecting said motor to said device, an outer rotor within said shroud connecting to said shaft of said motor, said outer rotor having a magnetic polarity, a stationary can within said outer rotor connecting to said housing, said stationary can lacking a magnetic polarity, and an inner rotor within said stationary can connecting to said shaft of said device, said inner rotor having a magnetic polarity opposite that of said outer rotor, said inner rotor having a band upon the circumference of said inner rotor, said band having a magnetic polarity opposite that of said outer rotor; and at least one fan upon said housing adapting to move atmospheric air over said housing, accelerating heat transfer from said device to the atmospheric air.

6. The device separating a working fluid from a cooling fluid within a housing of claim 5 further comprising:

said housing having an exterior surface including fins thereon accelerating the transfer of heat from said housing to the atmospheric air.

7. The device separating a working fluid from a cooling fluid within a housing of claim 5, further comprising:

a bellow surrounding said orbiting and fixed scrolls, said bellows being flexible, said bellows having a pair of ends, a flange connecting with each end of the bellows, and said flanges connecting with the fixed scroll and orbiting scrolls, and said bellows being inclined to accommodate the locating of the scrolls therein.

* * * * *

UNITED STATES PATENT AND TRADEMARK OFFICE

CERTIFICATE OF CORRECTION

PATENT NO. : 8,668,479 B2
APPLICATION NO. : 12/930140
DATED : March 11, 2014
INVENTOR(S) : Robert W. Shaffer It is certified that error appears in the above-identified patent and that said Letters Patent is hereby corrected as shown below:

On the Title Page, Item (73)
Incorrect:
Assignee: Air Squad, Inc., Broomfield, CO (US)

Correct:
Assignee: Air Squared, Inc., Broomfield, CO (US)

Signed and Sealed this
Nineteenth Day of August, 2014

Michelle K. Lee

Michelle K. Lee
*Deputy Director of the United States Patent and Trademark Office*